US007054571B2

(12) United States Patent
Camp et al.

(10) Patent No.: US 7,054,571 B2
(45) Date of Patent: May 30, 2006

(54) METHOD OF DRIVING A FUSER ROLL IN AN ELECTROPHOTOGRAPHIC PRINTER

(75) Inventors: Emily J. Camp, Lexington, KY (US); John W. Kietzman, Lexington, KY (US); Gregory L. Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 116 days.

(21) Appl. No.: 10/757,301

(22) Filed: Jan. 14, 2004

(65) Prior Publication Data

US 2005/0152710 A1 Jul. 14, 2005

(51) Int. Cl.
*G03G 15/20* (2006.01)
*G03G 15/00* (2006.01)

(52) U.S. Cl. ..... 399/68; 399/322; 399/400

(58) Field of Classification Search ..... 399/67, 399/68, 69, 320, 322, 328, 329, 330, 333, 399/400
See application file for complete search history.

(56) References Cited

U.S. PATENT DOCUMENTS

| | | | | |
|---|---|---|---|---|
| 4,017,067 | A * | 4/1977 | Soures et al. | 399/330 |
| 4,188,109 | A * | 2/1980 | Idenawa et al. | 399/322 |
| 4,319,874 | A | 3/1982 | Sawano | |
| 4,561,756 | A | 12/1985 | Lang | |
| 5,107,194 | A | 4/1992 | Poehlein | |
| 5,166,735 | A | 11/1992 | Malachowski | |
| 5,170,215 | A | 12/1992 | Pfeuffer | |
| 5,493,374 | A | 2/1996 | Smith | |
| 5,561,512 | A | 10/1996 | Fukano et al. | |
| 5,819,149 | A | 10/1998 | Watanabe et al. | |
| 5,839,038 | A | 11/1998 | Kopp et al. | |
| 5,956,543 | A | 9/1999 | Aslam et al. | |
| 5,983,049 | A | 11/1999 | Matsuya et al. | |
| 6,148,163 | A | 11/2000 | Ito | |
| 6,160,975 | A | 12/2000 | Bartley et al. | |
| 6,188,854 | B1 | 2/2001 | Coleman et al. | |
| 6,272,310 | B1 | 8/2001 | Blair et al. | |
| 6,381,422 | B1 | 4/2002 | Tanaka | |
| 6,445,901 | B1 | 9/2002 | Rasch et al. | |
| 6,567,624 | B1 * | 5/2003 | Murata | 399/69 |
| 6,567,640 | B1 * | 5/2003 | Ishikawa et al. | 399/329 |
| 6,661,989 | B1 * | 12/2003 | Pitts et al. | 399/322 |
| 6,704,526 | B1 * | 3/2004 | Nakamura | 399/68 |
| 6,799,000 | B1 * | 9/2004 | Aslam et al. | 399/67 |
| 6,816,686 | B1 * | 11/2004 | Hooper et al. | 399/68 |
| 2001/0028807 | A1 | 10/2001 | Coleman et al. | |
| 2002/0081121 | A1 | 6/2002 | Kamijo et al. | |
| 2002/0098019 | A1 | 7/2002 | Rasch et al. | |
| 2002/0141772 | A1 | 10/2002 | Kawano | |
| 2002/0146255 | A1 | 10/2002 | Kishimoto et al. | |
| 2002/0164173 | A1 | 11/2002 | Osada | |

FOREIGN PATENT DOCUMENTS

| | | |
|---|---|---|
| JP | 6032512 A | 11/1992 |
| JP | 6161175 A | 6/1994 |

* cited by examiner

*Primary Examiner*—Sandra L. Brase
(74) *Attorney, Agent, or Firm*—Stevens & Showalter, LLP

(57) ABSTRACT

A method of operating an electrophotographic printer includes the steps of: transporting a print medium at a first operating speed using a print medium transport assembly; transporting the print medium from the print medium transport assembly to a fuser assembly, the fuser assembly including a fuser roll; creating a bubble in the print medium between the paper transport assembly and the fuser assembly; determining a temperature associated with the fuser roll; and rotating the fuser roll at a second operating speed which is dependent upon the determined temperature.

23 Claims, 3 Drawing Sheets

METHOD OF DRIVING A FUSER ROLL IN AN ELECTROPHOTOGRAPHIC PRINTER

BACKGROUND OF THE INVENTION

1. Field of the Invention

The present invention relates to electrophotographic (EP) printers, and, more particularly, to a method of driving a fuser roll in such a printer.

2. Description of the Related Art

Cost and market pressures promote the design of the smallest possible printer with the shortest possible length of paper path. Short paper paths mean that media (especially legal-length media) are involved in more than one operation at once, and may span adjacent components. For example, a piece of paper in a printer which images directly onto paper may be at more than one imaging station while it is also in the fuser at the same time.

Tandem color laser printers which image directly onto paper typically use a paper transport belt to move media past successive imaging stations before fusing the final image onto the media. Velocity variation is a problem created when fuser or machine component tolerances or thermal growth affect the speed ratio between the fuser and the paper transport system upstream from it. Rather than having a constant ratio between the fuser and the paper transport system, this speed ratio varies from machine to machine and from time to time or mode to mode within the same machine. This can cause registration errors, and can cause scrubbing or other print defects as well.

For optimal registration of the imaging planes in tandem color laser printers, the surface speeds of the photoconductors and the media (in a direct-to-paper machine) must be precisely controlled. To achieve this, it is important that no external loads disturb the motor system moving the media. In a hot-roll fuser, the fusing nip is typically a high-force nip, with pressures on the order of 20 psi or more. This high-force nip has a sufficient grip on the media that the fuser will attempt to control the speed of the media regardless of what other systems are regulating its speed. The ability of a fuser to overwhelm other media feeding devices, and the problems this causes, may also be shared by other fuser technologies, such as belt fusers or fusers with belt backup members. For certain types of belt fusers, the backup roll is the driven member, so its effective drive diameter controls the speed of the media.

In direct-to-paper machines, if media is pulled taut between an imaging nip and a fusing nip operating at a higher speed, the disturbance force transmitted via the media from the fuser to the paper transport belt causes image registration errors. To prevent these, the fuser is often under driven so that a media bubble accumulates between the transport belt and the fuser. Since the fuser runs more slowly, the media never becomes taut, so less disturbance force can be transmitted from the fuser to the transport belt. However, the pursuit of small machines means that media bubbles must be constrained to stay as small as possible. If a machine is designed for a certain maximum bubble size, large velocity variations can make the media try to form a bigger bubble. If this happens, the media will probably make contact with machine features which scrape across the image area, causing print defects. The media might also "snap through", from the desired bubble configuration into a new one which is undesirable. This snapping action may also disturb the image and create print defects.

Ideally, the fuser is just slightly under driven so that a small paper bubble develops, but does not occupy much space in the machine. However, many factors affect the relative speeds of the transport belt and the fuser, potentially creating a large range of relative velocity variation. The nominal under drive of the fuser must be set such that the worst-case velocity variation condition still results in fuser under drive or exact speed matching, but never fuser over-drive (which would create taut media).

The speed of the media on a paper transport belt is set by the motion of the transport belt and photoconductive drums which form respective nips with the belt. The speed of the media in the fuser is controlled by the motion of the driven fuser member, roll compliance, drag on the backup roll, and friction coefficients between media and the two fuser rollers. In a hot-roll fuser, the hot roll is usually gear-driven while the backup roll idles on low-friction bearings. Therefore, the surface speed of the hot roll determines the speed of the media in the fuser. In some fuser systems where the backup roll is driven, the speed of that member controls the speed of the media.

The rotational speed of the hot roll results in a fuser-controlled media velocity at the nip which is dependent upon the diameter of the hot roll. As the temperature of the hot roll increases, the effective diameter of the hot roll also increases. The effective diameter of the hot roll at the nip is a function not only of the operating temperature, but also other parameters such as the nip load, dynamic effects as the hot roll rolls against the backup roll, etc. If operated at a constant rotational speed, this increase in the effective diameter caused by the increase in temperature of the hot roll results in an increased fuser-controlled media velocity.

What is needed in the art is a method of driving a fuser assembly which concurrently accommodates both the bubble formation of the print medium entering the fuser as well as the effects of temperature variation on the fuser.

SUMMARY OF THE INVENTION

The present invention provides an electrophotographic printer having a fuser roll which is driven in a manner to concurrently ensure that a bubble in the print medium occurs on the input side of the fuser assembly, and to correct for changes in the effective diameter of the fuser roll caused by temperature variations during operation.

The invention comprises, in one form thereof, a method of operating an electrophotographic printer, including the steps of: transporting a print medium at a first operating speed using a print medium transport assembly; transporting the print medium from the print medium transport assembly to a fuser assembly, the fuser assembly including a fuser roll; creating a bubble in the print medium between the paper transport assembly and the fuser assembly; determining a temperature associated with the fuser roll; and rotating the fuser roll at a second operating speed which is dependent upon the determined temperature.

An advantage of the present invention is that a bubble in the print medium is maintained at the input side to the fuser assembly.

Another advantage is that thermally induced variances in the effective diameter of the fuser roll are accommodated during operation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
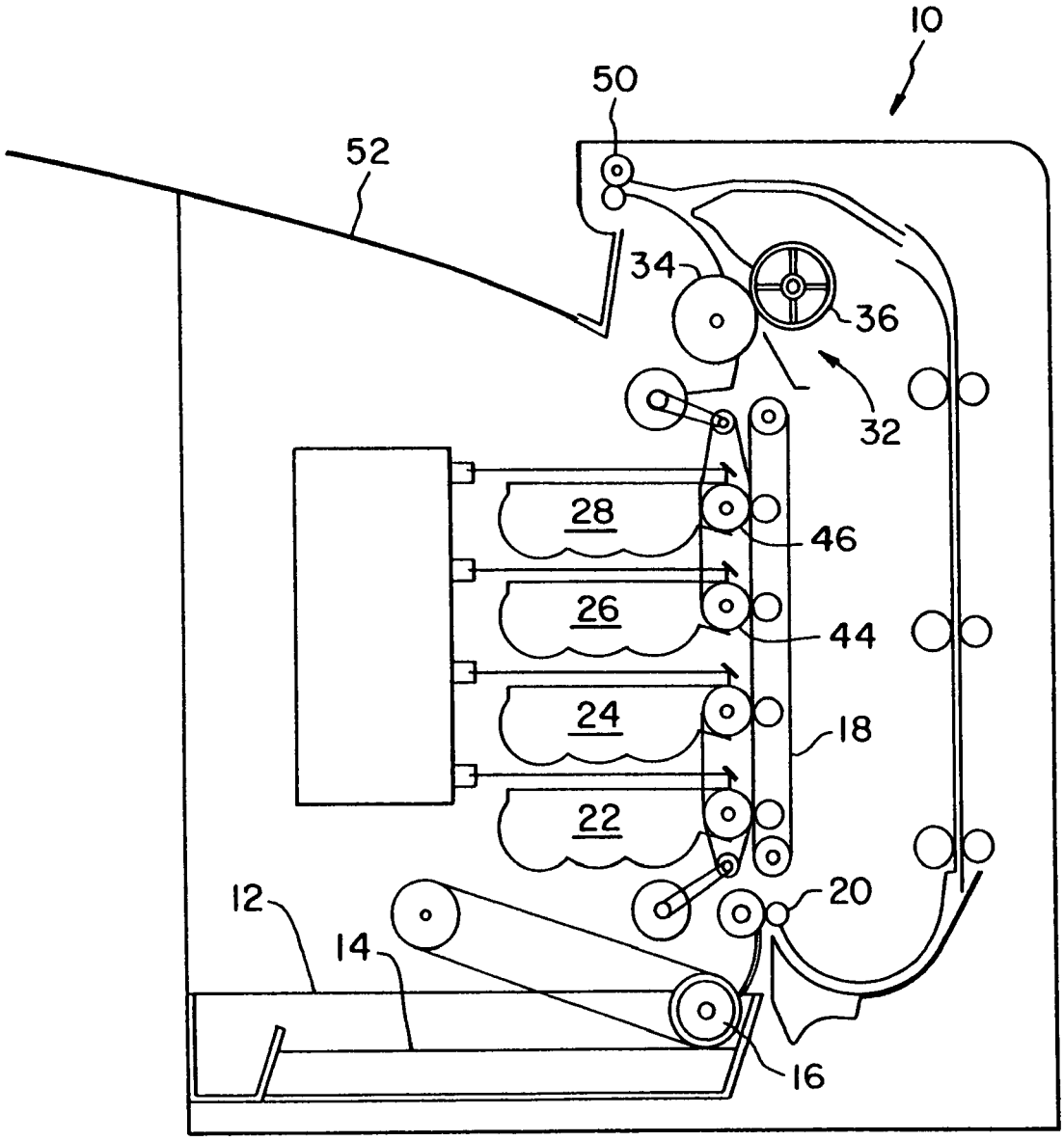
FIG. 1 is simplified side, sectional view of an embodiment of an electrophotographic printer of the present invention.

Referring now to the drawings and particularly to FIG. 1, there is shown an embodiment of an EP printer 10 of the present invention. Paper supply tray 12 contains a plurality of print media 14, such as paper, transparencies or the like. A print medium transport assembly (not numbered) includes a plurality of rolls and/or transport belts for transporting individual print media 14 through EP printer 10. For example, in the embodiment shown, the print medium transport assembly includes a pick roll 16 and a paper transport belt 18. Pick roll 16 picks an individual print medium 14 from within paper supply tray 12 and transports print medium 14 to a nip defined in part by roll 20 to paper transport belt 18. Paper transport belt 18 transports the individual print medium past a plurality of color imaging stations 22, 24, 26 and 28 which apply toner particles of a given color to print medium 14 at selected pixel locations. In the embodiment shown, color imaging station 22 is a black (K) color imaging station; color imaging station 24 is a yellow (Y) color imaging station; color imaging station 26 is a magenta (M) color imaging station; and color imaging station 28 is a cyan (C) color imaging station.

Figure 2:
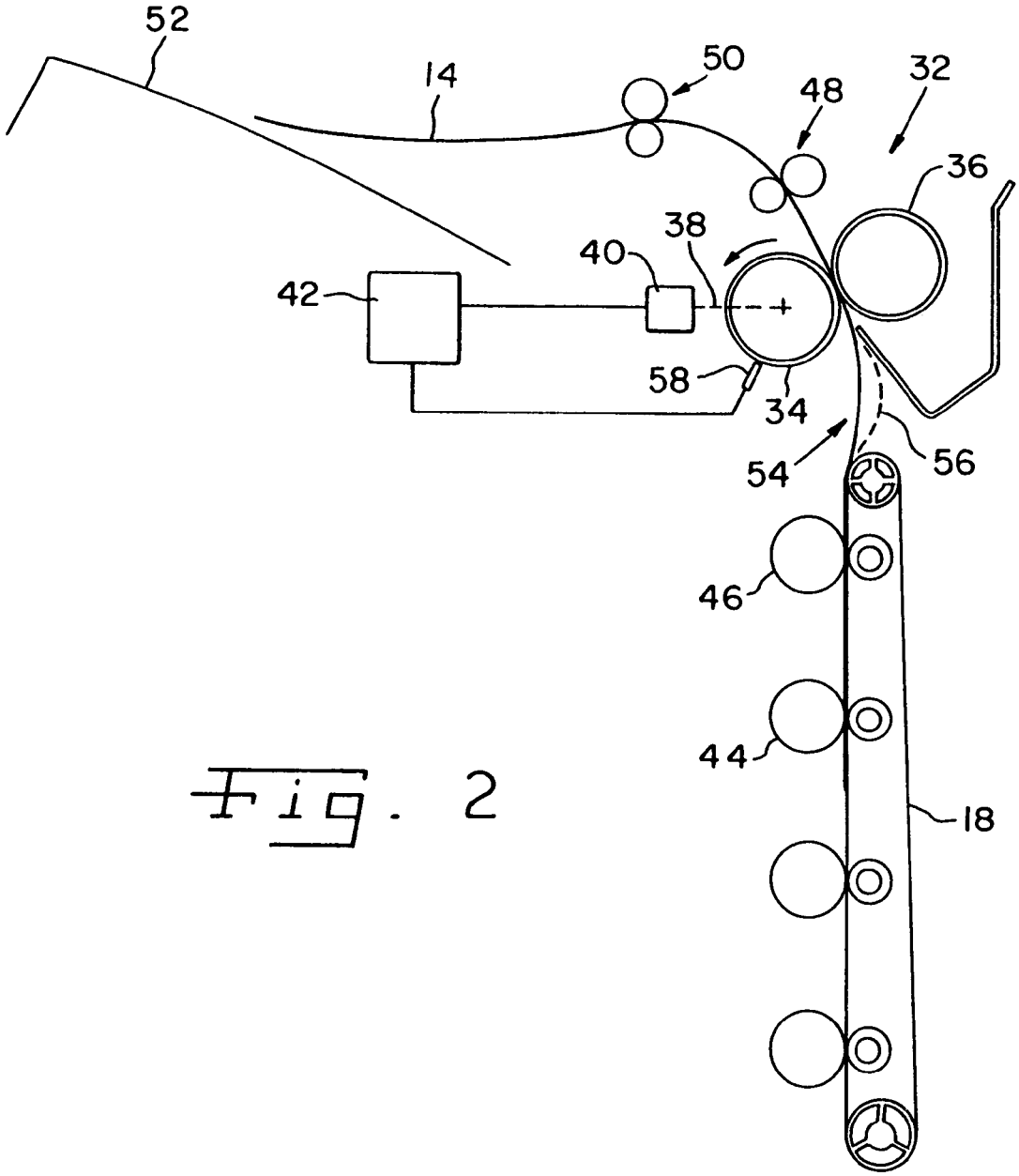
FIG. 2 is a schematic, side view of a portion of the paper transport assembly, fuser assembly including a hot roll and electrical circuit of the EP printer shown in FIG. 1.

Paper transport belt 18 transports an individual print medium 14 (FIG. 2) to fuser assembly 32 where the toner particles are fused to print medium 14 through the application of heat. Fuser assembly 32 includes a hot fuser roll 34 and a back up roll 36. In the embodiment shown, fuser roll 34 is a driven roll and back-up roll 36 is an idler roll; however, the drive scheme may be reversed depending upon the application. Techniques for the general concepts of heating fuser roll 34 and rotatably driving fuser roll 34 or back-up roll 36 using gears, belts, pulleys and the like (not shown) are conventional and not described in detail herein. Fuser roll 34 is schematically illustrated as being connected via phantom line 38 to drive motor 40, which is in turn connected to and controllably operated by electrical processing circuit 42, such as a microprocessor.

In the embodiment shown, print medium 14 is in the form of a legal length print medium. As is apparent, print medium 14 is concurrently present at the nips defined by a photoconductive (PC) drum 44 of color imaging station 26; a nip defined by PC drum 46 of color imaging station 28; a nip defined between fuser roll 34 and back-up roll 36; a nip defined by fuser exit rolls 48 and a nip defined by machine output rolls 50. The leading edge of print medium 14 is received within output tray 52 on the discharge side of machine output rolls 50.

As described above, it is undesirable to overdrive fuser roll 34 such that the fuser-controlled media velocity at the nip of fuser roll 34 exceeds the linear transport speed of paper transport belt 18. The force on the media from the nip between fuser roll 34 and back-up roll 36 typically is larger than the combination of the forces from the nips at PC drums 44 or 46 and the electrostatic force acting on the print medium, and thus the nip pressure and transport speed at fuser roll 34 tend to dominate the transport speed on paper transport belt 18. If fuser roll 34 is overdriven such that the fuser-controlled media velocity is greater than that of paper transport belt 18, then print defects may occur on print medium 14. For this reason, fuser roll 34 may be under driven to cause a slight bubble 54 in the gap between the discharge side of paper transport belt 18 and the input side of the nip between fuser roll 34 and back-up roll 36. This bubble 54 may be more pronounced, as illustrated by phantom line 56 in FIG. 2. If the size of bubble 54 becomes too large because of the velocity differences between fuser roll 34 and paper transport belt 18, then print medium 14 may contact physical features within printer 10 resulting in print defects. That is fuser roll 34 should be under driven, but not to such an extent that defects resulting from scraping, etc of print medium 14 occur. In the embodiment of EP printer 10 shown in the drawings, it has been found that a bubble 54 of print medium 14 can be accommodated when the velocity variation (relative to a set nominal velocity for each given size paper) does not exceed approximately 1.7% for legal size media; approximately 2.1% for A4 sized media; and approximately 2.2% for letter sized media. Based upon empirical testing and necessary safety factors, a maximum velocity variation of approximately 1.5% has been set as a maximum velocity variation level that can be accepted without difficulties.

In the embodiment shown, each of fuser roll 34 and back-up roll 36 have a PFA sleeve at the outside diameter over an elastomeric layer. The outside diameter of fuser roll 34 and back-up roll 36 is approximately 36 mm at the outside diameter of the PFA sleeve when measured cold. It will be appreciated that the outside diameter of fuser roll 34 increases as the operating temperature of fuser roll 34 increases. For example, the sensed fuser roll temperature can increase the effective diameter of fuser roll 34 up to approximately 0.37% for legal-sized paper (over an operating temperature range of approximately 143 to 172° C.); and approximately 0.57% for letter-sized print media (over an operating temperature range of approximately 138 to 182° C.).

According to one aspect of the present invention, velocity variations of fuser roll 34 are accommodated by measuring the temperature of fuser roll 34 using a sensor 58 coupled with electrical processing circuit 42. Temperature sensor 58 may be of any suitable type, such as a thermistor, etc. The fuser speed is adjusted to correct for the current measured temperature of fuser roll 34 or a short term average of the temperature of fuser roll 34. A correction factor may also be applied to the measured temperature to account for the cooling of fuser roll 34 as a print medium enters fuser assembly 32. This may be implemented using a look up table in electrical processing circuit 42 or using a mathematical formula.

Another method of carrying out the present invention is to perform a correction by adjusting the fuser speed based on the nominal temperature which is used for a current fuser mode. Depending on a current media type, roughness and other parameters, fuser assembly 32 is operated at a certain nominal temperature setting. This temperature set point can be used to look up a desired fuser speed which should maintain a constant media speed. The following table illustrates an example of initial estimated nominal temperature set points for fuser assembly 32:

| Paper | Speed | Nominal Temperature | Media Size |
|---|---|---|---|
| 16# | 8 ppm | 143 | Letter |
| 90# | 8 ppm | 160 | Letter |
| 20/24# | 8 ppm | 148 | Letter/Legal |
| 16# | 16 ppm | 148 | Letter |
| 20/24# | 16 ppm | 160 | Letter/Legal |
| 24# bond | 16 ppm | 170 | Letter |
| Transparency | 6 ppm | 160 | Letter |

Based on these estimated operating temperatures for various media and speeds, a range of nominal temperature operating points for each media size is determined. In the embodiment shown, the range of nominal temperature operating points for a legal sized print medium and a letter sized print medium is determined as follows:

| | |
|---|---|
| General range of nominal op points | 60–190° C. |
| Specific range of nominal op points | 145–170° C. |
| Specific range of nominal op points for legal size paper | 148–160° C. |
| Specific range of nominal op points for letter size paper | 143–170° C. |

The previous specific nominal temperature settings are the temperatures the fuser is directed to maintain during operation. Various factors introduce variation about these target temperatures, resulting in a wider range of possible operating points, shown below:

| | |
|---|---|
| Range of possible op points for legal size paper | 143–172° C. |
| Range of possible op points for letter size paper | 138–182° C. |

The range of possible temperature operating points listed above represents a range between 5° C. below the nominal temperature to 12° C. above the nominal temperature. This range reflects a combination of thermal tolerances expected during operation, including thermistor part-to-part variation, A/D tolerances as a thermistor is read by the printer, progressive contamination of a thermistor over life, etc.

The combined effect of the possible range of temperature and rubber thickness for media over the legal-sized temperature operating range results in a 0.47% velocity variation in fuser speed (over an operating temperature range of approximately 143 to 172° C.). The combined effect over the letter-sized temperature operating range results in a 0.68% velocity variation (over an operating temperature range of approximately 138 to 182° C.).

If the fuser speed is adjusted to compensate for the effective diameter of the nominal fuser hot roll temperature setting, then velocity variation can be reduced. Over the temperature range which must be supported for letter-sized media, this reduction is substantial. It is slightly less over the temperature range for legal media. The correction factor adjusts for the nominal fuser temperature, but it does not account for inaccuracy in setting or measuring fuser temperatures, nor will it account for a difference from the nominal elastomer thickness of a given hot roll, nor for the interaction between the elastomer thickness and effective diameter variation with temperature. Despite this limitation, this technique still reduces velocity variation significantly. Over the narrow temperature range being considered for legal-sized media, velocity variation can be reduced by 0.15%. Over the wider temperature range being considered for letter-sized media, velocity variation can be reduced by 0.34%. This is summarized in the following table, which lists velocity variation due to elastomer thickness and roll temperature:

| | Legal-sized media | Letter-sized media |
|---|---|---|
| Velocity variation without correction: | 0.47% | 0.68% |
| Improvement via speed correction: | −0.15% | −0.34% |
| Velocity variation with speed correction: | 0.32% | 0.34% |

Thus, by adjusting for the variations in the operating temperature of fuser roll 34 during operation, variations in the velocity of fuser roll 34 are also controlled to a greater extent, which in turn results in control of the formation of print medium bubble 54 between paper transport belt 18 and fuser assembly 32.

In the embodiment shown in the drawings and described above, a temperature sensor is used to sense the operating temperature of fuser roll 34. However, it is also possible to theoretically or empirically determine the temperature characteristics of fuser roll 34 or other driven member, and set the rotational speed of fuser roll 34 using data in a look-up table rather than actual sensed data.

Figure 3:
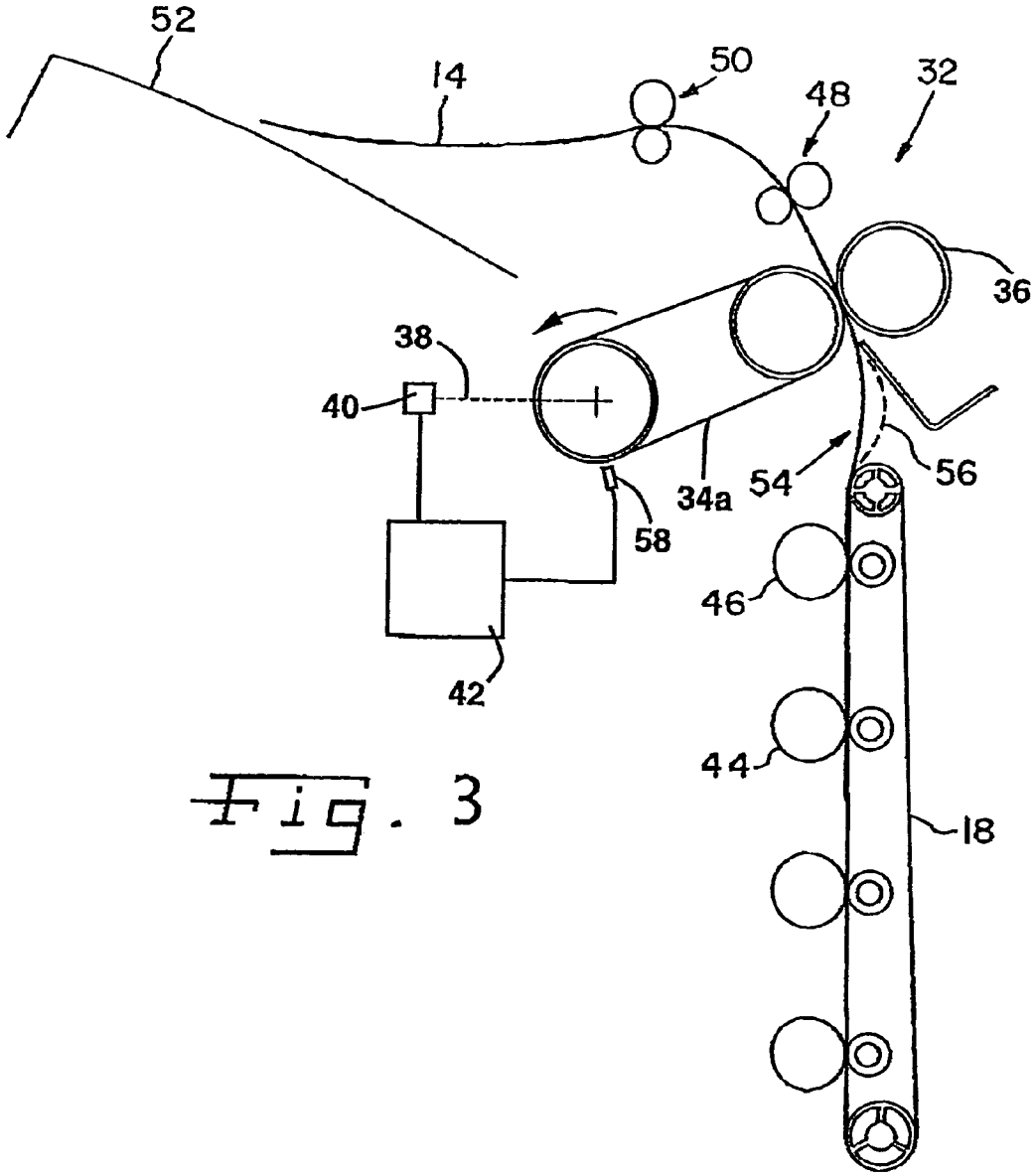
FIG. 3 is a schematic, side view of a portion of the paper transport assembly, fuser assembly including a heated belt and electrical circuit of an EP printer.

Further, in the embodiment shown in the drawings and described above, the fuser assembly includes a hot fuser roll and backup roll. However, it is to be understood that the methodology of the present invention likewise applies to other fuser configurations, such as those including a heated backup roll, belts, etc. In the case of a driven backup roll, it is the rotational speed of the backup roll that is controlled. In the case of a belt fuser with a ceramic heater for heating the belt and an unheated, driven backup roll, the backup roll can increase in effective diameter up to approximately 2.5% over an operating temperature range of the fuser; and in one embodiment up to approximately 1.2% over an operating temperature range of the fuser. In FIG. 3, where like reference numerals indicate like elements, a driven heated belt 34*a* is provided in place of the driven hot fuser roll 34 in FIG. 2.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of operating an electrophotographic printer, comprising the steps of:

transporting a print medium at a first operating speed using a print medium transport assembly to a fuser assembly including a fuser roll;

determining a temperature associated with said fuser roll; and rotating said fuser roll at a second operating speed which is dependent upon said determined temperature such that a bubble in the print medium between said paper transport assembly and said fuser assembly is created.

2. The method of claim 1, wherein said first operating speed is a linear speed and said second operating speed is a rotational speed.

3. The method of claim 2, wherein said rotational speed is dependent upon an effective diameter of said fuser roll, said effective diameter being dependent upon said determined temperature.

4. The method of claim 3, wherein said effective diameter increases up to 2.5% of a nominal fuser roll diameter over an operating temperature range of said fuser roll.

5. The method of claim 4, wherein said effective diameter increases up to 1.2% of a nominal fuser roll diameter over an operating temperature range of said fuser roll.

6. The method of claim 1, wherein said determined temperature is between approximately 60° C. to 190° C.

7. The method of claim 6, wherein said determined temperature is between approximately 145° C. to 170° C.

8. The method of claim 1, including the step of setting a nominal operating temperature of said fuser roll, dependent upon physical properties of the print medium.

9. The method of claim 1, including the step of changing said second operating speed to a different second operating speed when a print medium is not present at said fuser roll.

10. The method of claim 1, wherein said bubble in the print medium is created by driving said fuser roll at a second operating speed corresponding to a linear speed which is slower than said first operating speed.

11. The method of claim 1, wherein said determining step comprises one of:

determining said temperature of said fuser roll using a look-up table; and sensing a temperature of said fuser roll.

12. A method of operating an electrophotographic printer, comprising the steps of:

transporting a print medium at a first operating speed using a print medium transport assembly to a fuser assembly including a driven member, said print medium transport assembly including at least one of a belt and a plurality of rolls and said driven member including one of a roll and a belt;

determining a temperature associated with said driven member; and driving said driven member at a second operating speed which is dependent upon said determined temperature such that a bubble is created in the print medium between said print medium transport assembly and said fuser assembly.

13. The method of claim 12, wherein said driven member is a fuser roll, said first operating speed is a linear speed and said second operating speed is a rotational speed.

14. The method of claim 13, wherein said rotational speed is dependent upon an effective diameter of said fuser roll, said effective diameter being dependent upon said determined temperature.

15. The method of claim 14, wherein said effective diameter increases up to 2.5% of a nominal fuser roll diameter over an operating temperature range of said fuser roll.

16. The method of claim 15, wherein said effective diameter increases up to 1.2% of a nominal fuser roll diameter over an operating temperature range of said fuser roll.

17. The method of claim 15, wherein said effective diameter increases approximately 0.37% for a legal size print medium, and increases approximately 0.57% for a letter size print medium.

18. The method of claim 12, wherein said determined temperature is between approximately 60° C. to 190° C.

19. The method of claim 18, wherein said determined temperature is between approximately 145° C. to 170° C.

20. The method of claim 12, including the step of setting a nominal operating temperature of said driven member, dependent upon physical properties of the print medium.

21. The method of claim 12, wherein said determining step comprises one of:

determining said temperature of said driven member using a look-up table; and sensing a temperature of said driven member.

22. The method of claim 12, including the step of changing said second operating speed to a different second operating speed when a print medium is not present in a fusing region of said fuser assembly.

23. The method of claim 12, wherein said bubble in the print medium is created by driving said driven member at a second operating speed corresponding to a linear speed which is slower than said first operating speed.

* * * * *